US005423548A

United States Patent [19]

Bricker

[11] Patent Number: 5,423,548

[45] Date of Patent: Jun. 13, 1995

[54] GOLF SWING PLANE GUIDE AND TRAINING APPARATUS

[76] Inventor: James C. Bricker, 2935 O'Neall Rd., Waynesville, Ohio 45068

[21] Appl. No.: 245,867

[22] Filed: May 19, 1994

[51] Int. Cl.[6] ..... A63B 69/36

[52] U.S. Cl. ..... 273/191 A

[58] Field of Search ..... 273/191 R, 191 A, 191 B, 273/192, 186.1

[56] References Cited

U.S. PATENT DOCUMENTS

| | | | |
|---|---|---|---|
| 1,944,942 | 1/1934 | Mac Donald | 273/191 A |
| 3,339,927 | 9/1967 | Nunn | 273/191 A |
| 3,341,208 | 9/1967 | Marcella | 273/191 A |
| 3,370,531 | 5/1973 | Zega | 273/191 A |
| 3,489,416 | 1/1970 | Mark | 273/191 A |
| 4,949,974 | 8/1990 | Bellagamba | 273/191 A |

*Primary Examiner*—George J. Marlo
*Attorney, Agent, or Firm*—Wood, Herron & Evans

[57] ABSTRACT

Golf swing training apparatus includes a first guide surface and a second, steeper golf club guide surface. The first guide surface is angularly adjustable to set the appropriate initial plane of the back swing for a particular golfer and the second guide surface is further angularly adjustable relative to the first guide surface to set the appropriate second plane of the back swing for the golfer using a particular golf club. To facilitate changeover from right-handed to left-handed operation, the second guide surface is releasably connectable to either of two upper ends of the apparatus. The frame structure is constructed out of a material which is rigid at approximately room temperature. At least the first golf club guide surface is disposed on a guide member secured to the rigid frame structure and formed from a polymeric material which is sufficiently flexible at room temperature so as to be bendable into an arcuate or curved shape which follows the swing path of the golfer. In another aspect of the invention, the entire apparatus is easily broken down or folded into a condition suitable for easy storage and transport.

25 Claims, 4 Drawing Sheets

GOLF SWING PLANE GUIDE AND TRAINING APPARATUS

BACKGROUND OF THE INVENTION

The present invention generally relates to golf training and teaching aids and, more particularly, to swing training devices of the type in which a student stands adjacent the device and swings the golf club while maintaining contact with a guide surface of the device.

Many factors come into play during a golf swing which determine whether the intended shot is properly executed. A few of these factors include the golfer's grip on the club, the golfer's alignment both with respect to the intended target area and with respect to the ball, the golfer's leg "action" or movement during the swing and, of course, the golf swing itself. Of these, the golf swing itself is the most difficult aspect of a golfer's game to either correct or at least alter in a way that results in consistently improved golf shots.

Often times, accomplished golfers who have played and/or practiced enough golf to have thereby developed a proper golf swing into a naturally reflexive or habitual motion are referred to as having "grooved" their golf swing. Of course, even golfers having higher handicaps, i.e., those golfers who generally score well above par, may practice and/or play on a continuous basis and thereby "groove" a swing into a naturally reflexive or habitual motion. The problem with this latter group, however, is that an improper swing has been "grooved" or developed as a naturally reflexive or habitual motion. This improper, but now natural or habitual, swinging motion of this latter group of golfers is one that is very difficult to correct.

Golf swing training aids have been developed for helping golfers to "groove" or develop a swing into a naturally reflexive or habitual motion. Many of these devices generally involve the use of a curved frame structure having a guide surface along which the golf club shaft travels during a golfer's practice swing. If used repeatedly, these devices will all help the golfer "groove" or develop a swing which follows the guide path defined by the practice device. The problem with current and past devices of this type, however, is that the path defined by the guide surface in each case is not a proper swing path and, therefore, these devices generally cause golfers to "groove" or develop improper swings.

Specifically, devices such as those shown in U.S. Pat. Nos. 3,339,927; 3,341,208; 3,489,416; 3,730,531; and 4,949,974 all suffer from the undesirable probability of causing the user to develop an improper golf swing. Generally speaking, devices of the type disclosed in the above patents include a guide member or surface which lies in a single plane. Although, in some of these devices, the guide member or surface may be adjusted to a reflect a different guide plane and although this guide plane may correspond to the initial plane in which a golf club shaft travels immediately upon take away of the club head from the golf ball, a single guide plane simplifies the true motion of a proper golf swing to such an extent that these devices may do more harm than good.

Golf swing training devices have also generally been bulky and therefore cumbersome to transport, set up and use and have further been incapable of easy breakdown after use. Due the bulk and complexity of these devices along with their inability to be easily broken down, these devices have necessarily been expensive to manufacture and transport. Moreover, as completely rigid frame structures are employed in these devices, expensive manufacturing methods are necessary to form the curved guide members which form a part of the frame structure.

A golf swing training aid is therefore needed which, most importantly, helps golfers to develop proper swings, but which is also inexpensive to manufacture, easy to transport and easily set up and broken down.

SUMMARY OF THE INVENTION

It has therefore been one object of the invention to provide a golf swing training device which facilitates training a golfer to develop a swing along a proper swing path.

It has been further object of the invention to provide swing training apparatus including a guide surface having first and second guide surface portions at different relative angles to the horizontal.

It has been still a further object of the invention to provide swing training apparatus wherein the first guide surface portion is at a first angle to the horizontal and the second guide surface portion is at a second, steeper angle to the horizontal.

It has been still a further object of the invention to provide swing training apparatus wherein the first and second guide surface portions are angularly adjustable both as a unit as well as with respect to one another to accommodate the needs of different golfers and/or clubs.

It has been another object of the invention to provide golf swing training apparatus which is inexpensive to manufacture, light weight, easily folded and/or disassembled for transport and easily set up for use.

To these ends, the invention comprises apparatus including a rigid frame structure having a lower portion which includes a first golf club guide surface disposed at a first angle relative to horizontal. An upper extension portion of the frame structure includes a second golf club guide surface which, in use, is preferably disposed at a steeper angle to the horizontal than the first golf club guide surface. This is because a proper back swing involves initial movement of the golf club away from the ball in a first swing plane and subsequent movement of the golf club, starting approximately at the "9-o'clock" position of the golf swing, in a second, steeper swing plane relative to horizontal.

The first guide surface is angularly adjustable to set the appropriate initial plane of the back swing for a particular golfer and the second guide surface is angularly adjustable relative to the first guide surface to set the appropriate second plane of the back swing for the golfer using a particular golf club. More specifically, the upper extension portion of the frame structure is attached to the lower portion of the frame structure so as to allow angular movement of the upper extension portion relative to the lower portion of the frame structure.

The lower portion of the frame structure is generally arcuately shaped and includes first and second opposite, upper ends. The extension portion is connected to a selected one of the first and second upper ends depending on whether a right or left-handed golfer is using the device. To facilitate change-over from right-handed to left-handed operation, the upper extension portion is releasably connectable to either of the upper ends of the lower frame portion.

The lower portion of the frame structure more specifically comprises first and second generally arcuate sections hingedly connected to one another at a central portion of the frame structure. First and second legs are respectively connected to the first and second generally arcuate sections such that the frame structure is free standing. Preferably, the first and second legs are angularly adjustable relative to the arcuate sections of the frame structure to thereby allow angular adjustment of the first and second guide surfaces as a unit.

As mentioned above, the upper extension portion is releasably connected to one of the first and second generally arcuate sections, depending on whether a right or left-handed golfer is using the device, and is further connected to a corresponding one of the first and second legs. The upper extension portion is adjustably connected between the selected generally arcuate section and the corresponding leg in a manner which allows the first and second golf club guide surfaces to be disposed at different relative angles to the horizontal.

In another aspect of the invention which, for example, facilitates efficient manufacturing of the apparatus, the entire frame structure is constructed out of a material which is rigid at approximately room temperature, as well as at outside temperatures which would typically be experienced during transport and use of the device. This material may, for example, be polyvinylchloride (PVC) tubing. A pair of first guide members are secured to the rigid frame structure and formed from a polymeric material, such as polypropylene, which is sufficiently flexible at room temperature so as to be bendable into an arcuate or curved shape which follows the swing path of the golfer. One of the guide members is an upper guide member for guiding an upper portion of a golf club shaft and the other of the guide members is a lower guide member for guiding a lower portion of the golf club shaft. Two parallel guide members on the upper extension portion of the frame structure need not be bent into a curved shape and therefore may be formed of material which is rigid at room temperature if desired.

In another aspect of the invention, the entire apparatus is easily broken down or folded into a condition suitable for easy storage and transport. This is facilitated by the hinged connections between the lower arcuate sections of the frame structure as well as the hinged connections between the legs and the lower arcuate sections of the frame structure as well as the hinged connections of the upper extension portion.

Further objects and advantages will become more readily apparent to those of skill in the art upon review of the following detailed description of a preferred embodiment of the invention taken in conjunction with the accompanying drawings.

BRIEF DESCRIPTION OF THE DRAWINGS

FIG. 2A is a perspective view similar to FIG. 2 but showing the apparatus in the process of being folded for storage, transport and the like;

DETAILED DESCRIPTION OF THE PREFERRED EMBODIMENT

Figure 1:
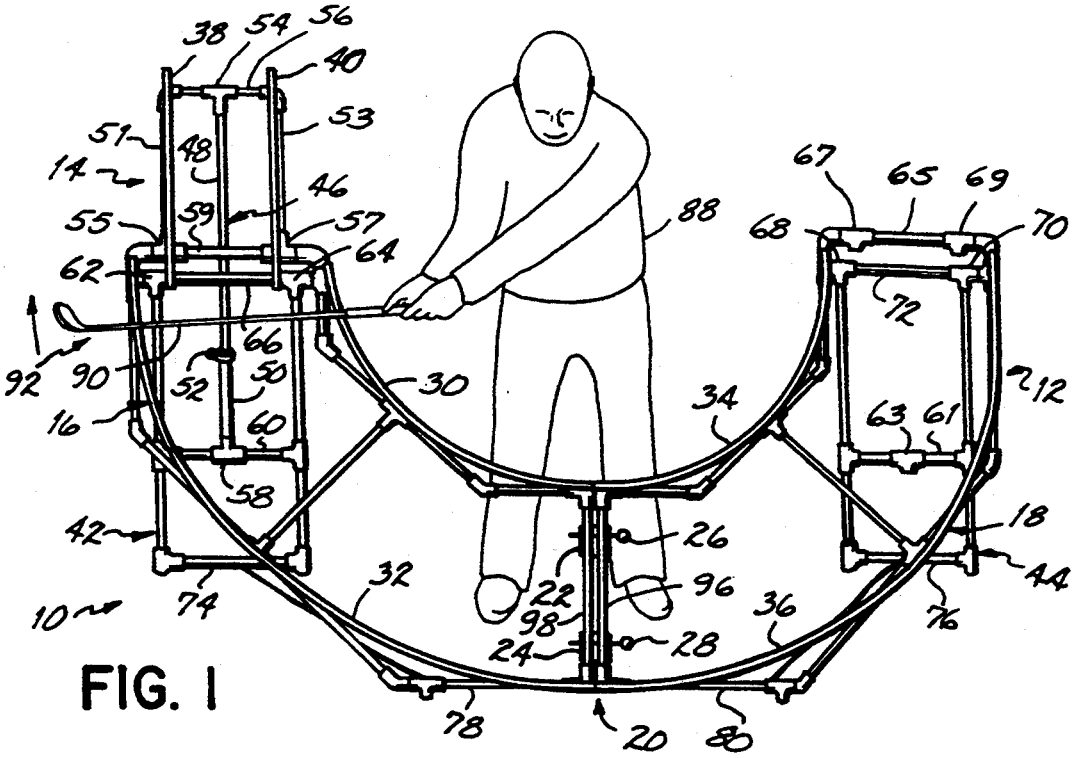
FIG. 1 is a front perspective view of a preferred embodiment of the golf swing training apparatus and of the proper positioning of a golfer with respect thereto during a practice back swing.

Referring first to FIG. 1, a golf training apparatus 10 of the present invention includes a lower portion 12 which is generally arcuate or, more specifically, semicircular in shape and an attached upper extension portion 14. The lower generally arcuate portion 12 is formed from two smaller generally arcuate sections 16, 18 hingedly connected at a central area 20 of the lower generally arcuate portion 12 by way of hinges 22, 24 which may be locked in the positions shown by locking pins 26, 28 as further described below. Arcuate frame section 16 includes curved upper and lower golf club shaft guide members 30, 32 and arcuate section 18 likewise includes curved golf club shaft guide members 34, 36. It will be appreciated from FIG. 1 that guide members 30, 34 combine to provide a substantially continuous guide surface for the upper portion of a golf club shaft 90 while the lower guide members 32, 36 combine to provide a substantially continuous guide surface for the lower portion of the golf club shaft 90. Upper extension portion 14 of apparatus 10 also includes first and second guide members 38, 40 for providing a guide surface for the golf club shaft 90 on the back swing as the golfer 88 approaches approximately the "9 o'clock" position of the back swing as viewed from the perspective of FIG. 1. Although guide members 38, 40 are shown to be positioned between guide member 30, 32, as viewed in FIG. 1, it will be appreciated that they may alternatively be generally aligned therewith or positioned outside of guide members 30, 32 if desired. Upper extension portion 14 comprises an angularly adjustable golf club guide surface pivotally connected to the upper end of arcuate section 16 such that apparatus 10 may be used for a right-handed golfer for back swing practice as shown in FIG. 1. As further discussed below, upper extension portion 14 may be identically connected to the upper end of arcuate section 18 if the apparatus 10 is desired to be used for a left-handed golfer. Further description of this feature will therefore be understood to encompass either location for extension portion or angularly adjustable portion 14 although only the right-handed version is shown in the drawings.

Figure 2:
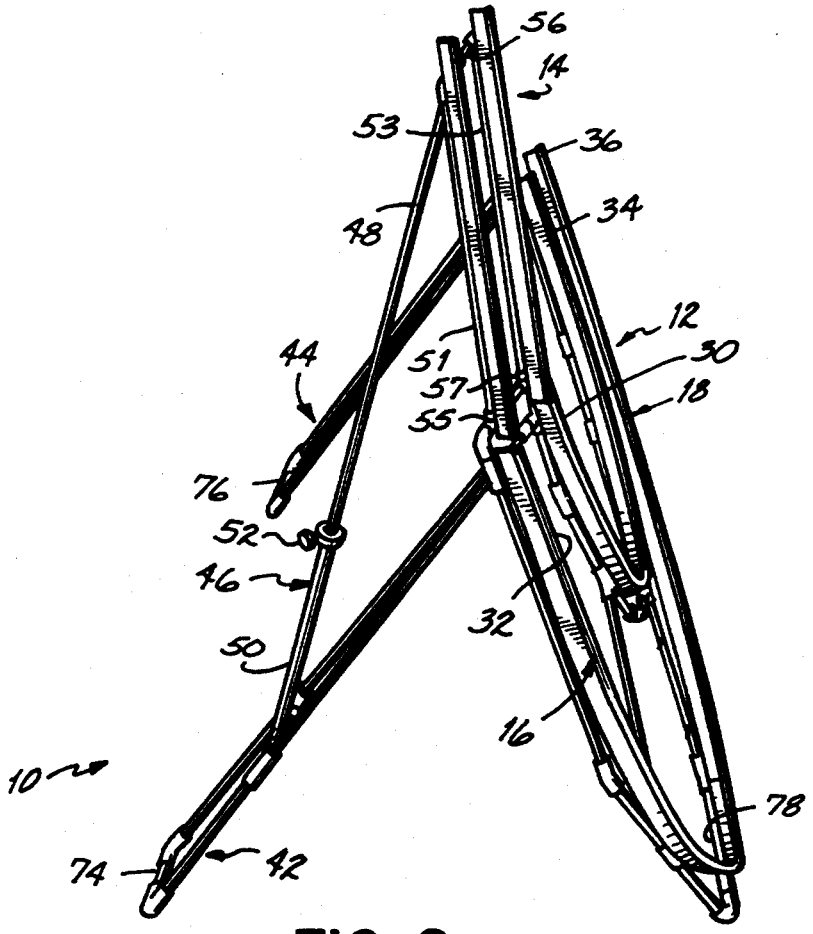
FIG. 2 is a side perspective view of the apparatus of FIG. 1.

As illustrated in FIGS. 1 and 2, apparatus 10 further includes two support legs 42, 44 each being hingedly or pivotally secured to respective opposite upper ends of the lower generally arcuate portion 12 of apparatus 10. A length-adjustable rod 46 is secured between the upper extension portion 14 and one leg 42 such that the apparatus 10 may be used for a right-handed golfer. As discussed further below, leg 44 and frame section 18 also include certain connectors, etc., which enable upper extension portion 14 to be secured thereto such that apparatus 10 may be used for left-handed golfers. Length-adjustable rod 46 is comprised of two telescopically connected rods 48, 50 which may be telescopically adjusted with respect to one another and then fixed at a desired overall or combined length by way of a locking thumb screw 52 which extends through rod 50 and against rod 48. Referring specifically to FIG. 1, the upper end of telescopic rod 48 is secured to a tubular "T"-connector. "T"-connector 54 receives crossbar 56 of upper extension portion 14 and is rotatable about crossbar 56. Likewise, telescopic rod 50 is removably connected to a tubular "T"-connector 58 at a lower end thereof which rotatably receives a crossbar 60 of leg 42. Upper extension portion 14 is further comprised of a pair of side support bars 51, 53 rigidly connected to crossbar 56 at their upper ends and rotatably or pivotally connected to crossbar 59 of frame section 16 at their lower ends by respective tubular "T"-connectors 55, 57. Rotation of "T"-connectors 55, 57 about crossbar 59 changes the angular orientation of guide members 38, 40 with respect to guide members 30, 32. Rotation of connectors 54, 58 about respective crossbars 56, 60 allows length adjustment of rod 46 to occur and, as a consequence, allows angular adjustment of upper extension portion 14 with respect to lower generally arcuate section 12 as connectors 55, 57 rotate about crossbar 59.

Although not shown in any of the other figures, FIG. 1 illustrates the preferred option of having suitable connectors and bars on frame section 18 and leg 44 to enable upper extension portion 14, including length-adjustable rod 46, to be transferred from one side of apparatus 10 to the other for both right-handed and left-handed operation. Specifically, leg 44 includes a crossbar 61 and a rotatably received "T"-connector 63 which are analogous to cross bar 60 and "T"-connector 58 of leg 42. Also, frame section 18 includes an upper crossbar 65 which rotatably receives "T"-connectors 67, 69 analogous to crossbar 59 and "T"-connectors 55, 57 of frame section 16. Side support bars 51, 53 are removably receivable by "T"-connectors 55, 57 of frame section 16 and also by "T"-connectors 67, 69 of frame section 18. In addition, telescopic rod 50 may also be removably inserted into "T"-connector 58 of leg 42 as well as "T"-connector 63 of leg 44. Therefore, all that an instructor or user needs to do to convert apparatus 10 between a right-handed and a left-handed teaching aid is to pull rods 50, 51 and 53 out of the respective "T"-connectors 58, 55, 57 and insert them into respective "T"-connectors 63, 67, 69 or vice versa.

As further shown in FIG. 1, leg 42 is attached at its upper end to an upper portion of arcuate section 16 by way of tubular "T"-connectors 62, 64 which rotatably receive an upper crossbar 66 of section 16. In a like manner, leg 44 is connected at its upper end by way of two tubular "T"-connectors 68, 70 to the upper end of arcuate section 18. "T"-connectors 68, 70 rotatably receiving a crossbar 72 of arcuate section 18. It will thus be appreciated that legs 42, 44 may be angularly adjusted relative to respective arcuate sections 16, 18 to thereby change the plane in which guide members 30, 32, 34, 36 are disposed.

It should be noted that guide members 30, 32, 34, 36 include guide surfaces which are each disposed generally in the same plane when apparatus 10 is set up as shown in FIGS. 1 and 2. The plane defined by members 30, 32, 34, 36 corresponds to and defines the initial swing plane for a particular golfer at address and during the initial portion of the back swing. This plane will, of course, differ from golfer to golfer depending on various factors such as their stance, their height, the length of the golf club, etc. It should further be noted that means (not shown) are preferably provided for maintaining the angle of legs 42, 44 with respect to lower generally arcuate sections 16, 18. Such means may comprise, for example, U-shaped stakes which are staked into the ground about lower crossbars 74, 76 of legs 42, 44. If necessary, similar stakes may be provided for securing the generally arcuate lower section 12 to the ground, for example, by fixing frame members 78, 80 of arcuate sections 16, 18 with such stakes as well. Alternatively, or in addition to stakes, adjustable length ropes or chains may be respectively secured along the ground between legs 42, 44 and lower frame sections 16, 18.

The supporting frame structure of apparatus 10 is preferably formed by rigid tubular members being connected to one another by various angle and "T"-shaped connectors. The rigid frame members and "T"-shaped connectors may each be formed, for example, of polyvinylchloride (PVC) which is rigid at room temperature. Guide members 30, 32, 34, 36 are preferably constructed of a material which is flexible at room temperature such that it may be easily bent at room temperature into the desired curvature and then rigidly fastened to the rigid frame structure of apparatus 10. The preferred material for guide members 30, 32, 34, 36 is polypropylene. These guide members may be securely fastened to the rigid frame structure by any suitable fastening means (not shown) such as clips, rivets, nuts and bolts, and the like.

Figure 2A:
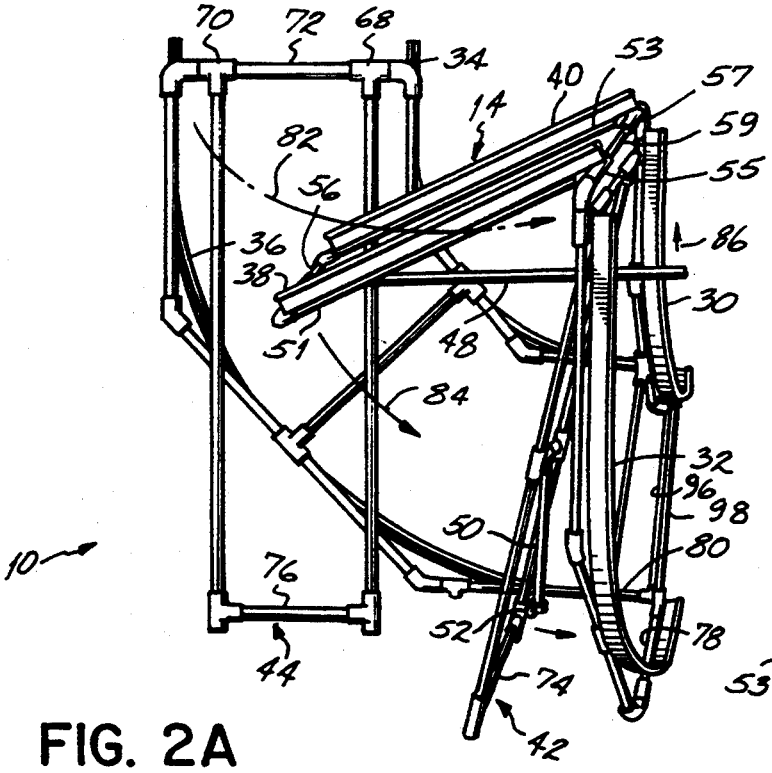

FIG. 2A shows the easy disassembly or folding breakdown of apparatus 10. More particularly, it will be appreciated that hinges 22, 24 allow arcuate sections 16, 18 to be folded toward one another as indicated in FIG. 2A by arrow 82. Furthermore, upper extension portion 14 may be folded downwardly with respect to arcuate section 16 and as indicated by arrow 84. Each leg 42, 44 may be folded inwardly toward the respective arcuate sections 16, 18. During disassembly or breakdown, length adjustable rod 46 is disassembled by removing telescopic rod 48 from telescopic rod 50 as shown in FIG. 2A before respectively folding upper extension portion 14 and leg 42. In this regard, telescopic rod 48 may be folded toward upper extension portion 14 as indicated by arrow 86 and telescopic 50 may be allowed to drop downwardly toward leg 42 during breakdown of apparatus 10.

Figure 3:
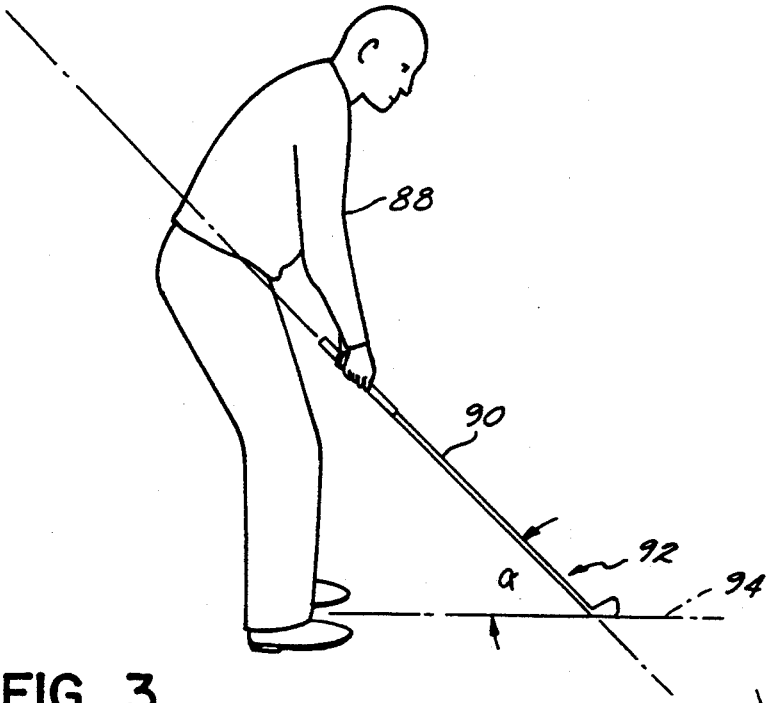
FIGS. 3 and 4 are diagrammatic views of a golfer's swing which generally illustrate the changing swing plane during a proper golf swing.
Figure 4:
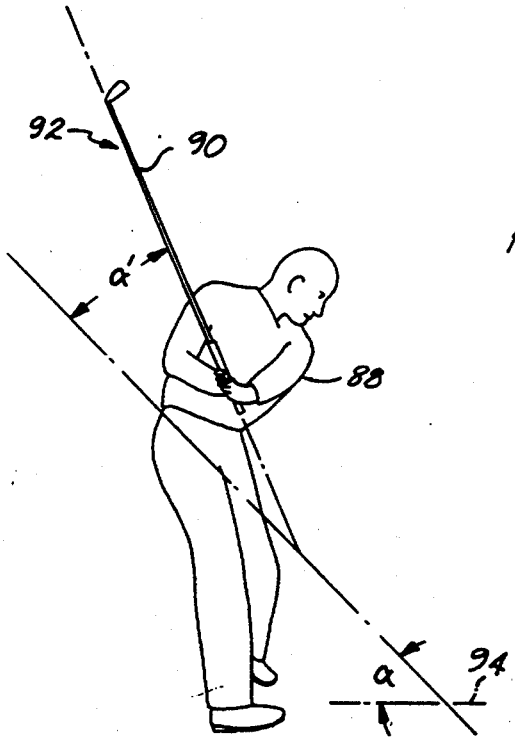
Figure 5:
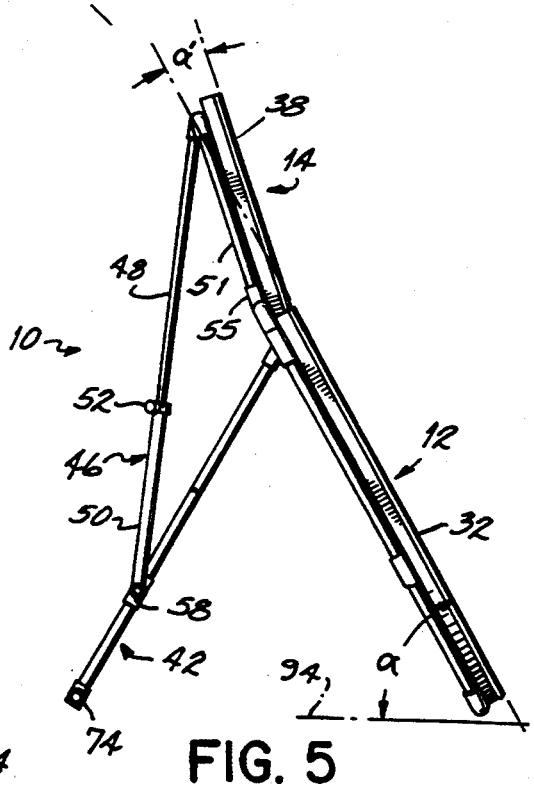
FIG. 5 is a side elevational view of the apparatus of FIG. 1 showing the first and second guide surfaces with the second or upper guide surface being disposed at a steeper angle to the horizontal.

FIGS. 3–5 illustrate the benefits of providing two swing plane guides which are angularly adjustable with respect to one another. Specifically, FIG. 3 shows a golfer 88 at address with the shaft 90 of a golf club 92 disposed at an angle $\alpha$ with respect to the horizontal which is represented by the ground surface 94. FIG. 4 illustrates a second swing plane disposed at a steeper angle $\alpha'$ with respect to the initial swing plane angle $\alpha$. The change or transition during the back swing to this steeper swing plane angle $(\alpha+\alpha')$ is necessary in order to execute a proper golf swing. As previously mentioned, the transition zone during which the golfer must change the swing plane over to this steeper plane to execute a proper back swing occurs approximately at the "9 o'clock" position of the golf swing as indicated generally by the position of the golf club 92 shown in FIG. 1. As further shown in FIG. 5, the swing plane apparatus 10 is adapted to be set up such that the lower, generally arcuate portion 12 thereof and, more specifically, guide members 30, 32, 34, 36 may be set at angle $\alpha$ which represents the initial swing plane of a particular golf club and golfer. Upper extension portion 14 and, more specifically, guide members 38, 40 disposed thereon may be adjusted as shown in FIG. 5 to angle $\alpha'$ with respect to angle $\alpha$. The specific relative angles of guide members 30, 32, 34, 36 and guide members 38, 40 will vary from golfer to golfer and club to club and are best determined by a golf instructor working directly with the student.

Figure 6:
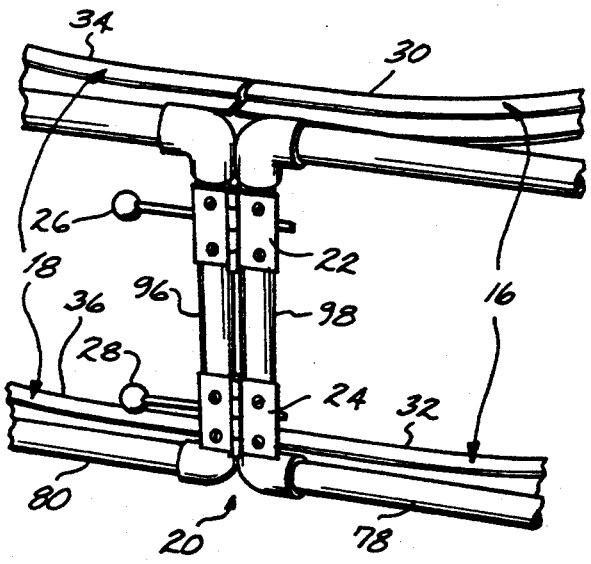
FIG. 6 is a rear perspective detail of the hinge and lock mechanism disposed centrally between two halves of the apparatus.
Figure 7:
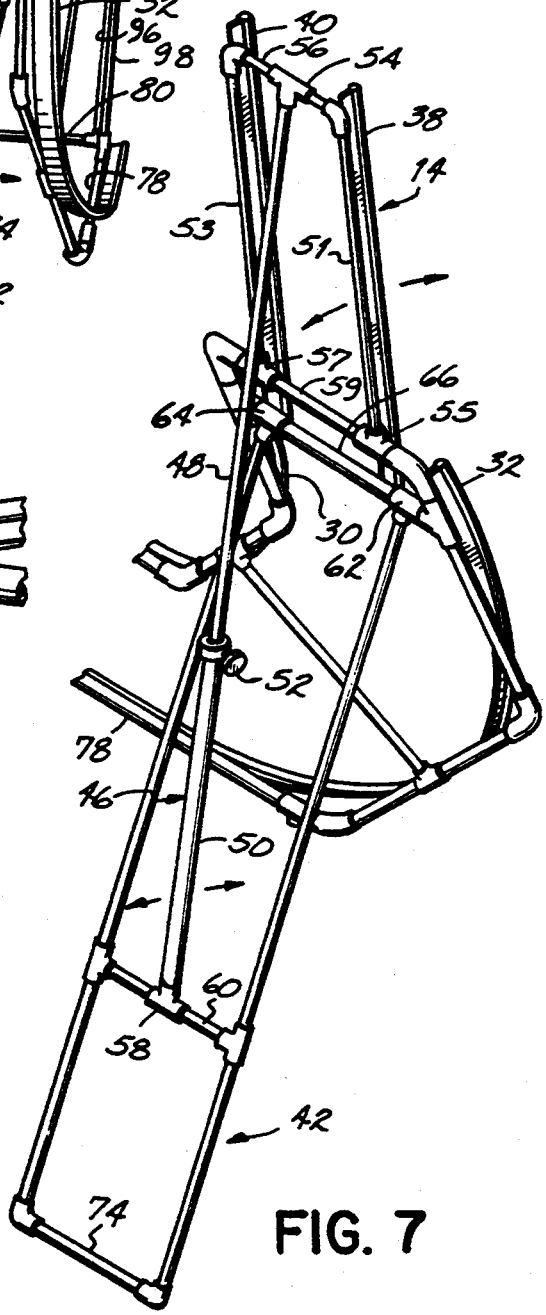
FIG. 7 is a rear perspective view of the upper, adjustable guide surface.

FIG. 6 illustrates in more detail hinges 22, 24 which connect lower arcuate sections 16, 18. Specifically, hinges 22, 24 are respectively secured to frame members 96, 98 of respective arcuate sections 16, 18. Locking pins 26, 28 are inserted through aligned apertures (not shown)in respective frame members 96, 98 behind hinges 22, 24. Thus, when locking pins 26, 28 are inserted through the aligned apertures in frame members 96, 98, lower arcuate sections 16, 18 are substantially prevented from any pivotal movement therebetween which would otherwise be allowed by hinges 22, 24. When locking pins 26, 28 are removed, lower arcuate section 16, 18 are free to be folded inwardly toward one another, for example, to facilitate storage and transport of apparatus 10.

Figure 8:
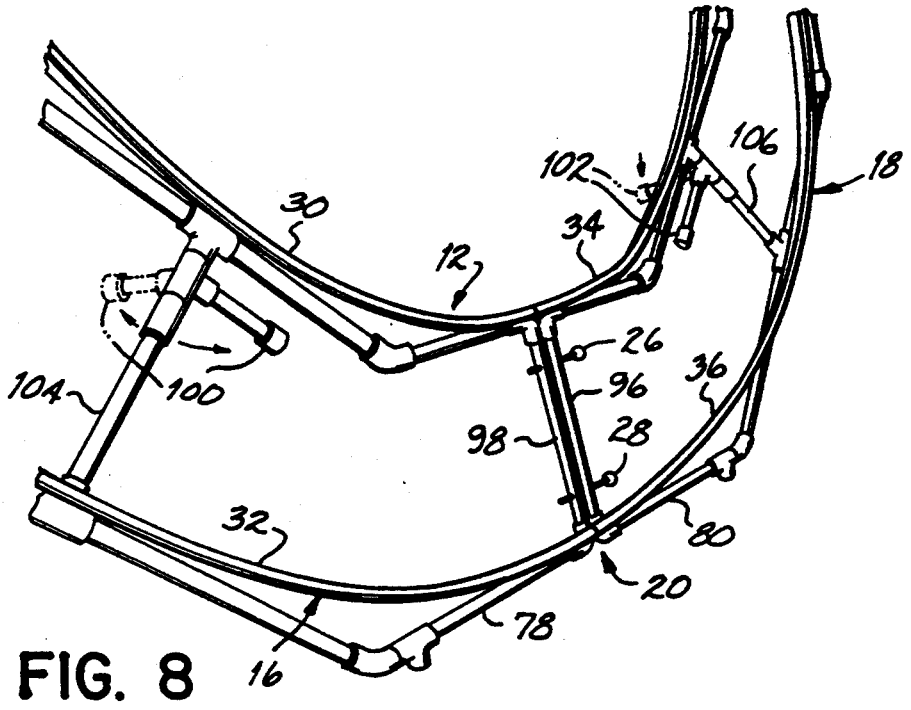
FIG. 8 is a front perspective of the apparatus showing the handles thereof being movable between use and non-use positions.

FIG. 8 illustrates handles 100, 102 which may be used to move apparatus 10 after it has been set up for use by a golfer. Handles 100, 102 are pivotally secured to frame members 104, 106 such that they may be rotated 90° between operating and nonoperating positions. The operating position is shown in phantom while the nonoperating position is shown in solid in FIG. 8. Thus, when it is desired to move apparatus 10 from one location to another after apparatus 10 has been set up, the user need only rotate the handles 100, 102 approximately 90° to the position shown in phantom and, while standing in the position normally assumed by the golfer as shown in FIG. 1, grasping handles 100, 102 and lifting and moving apparatus 10 to the desired location.

Figure 9:
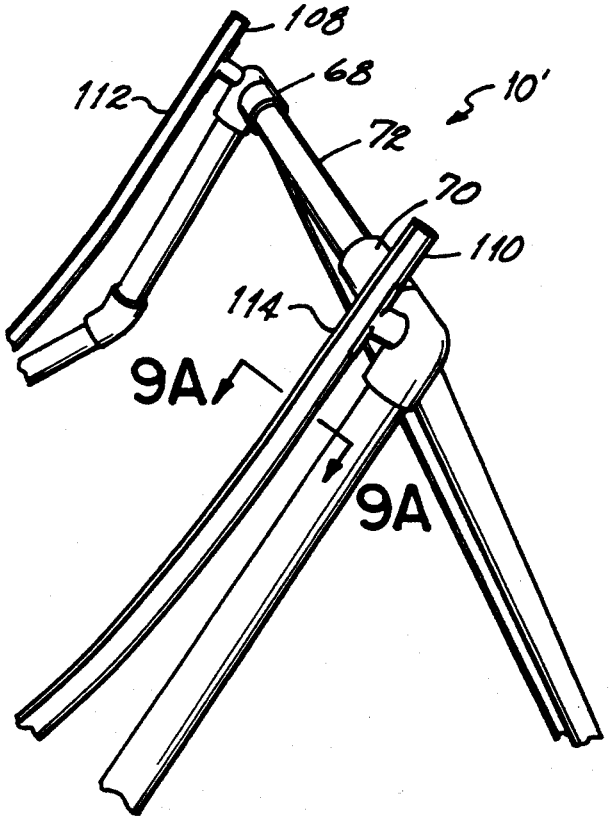
FIG. 9 is a partial front perspective view of the apparatus showing a portion of the swing guide members constructed according to an alternative embodiment; and, FIG. 9A is a cross sectional view taken along line 9A—9A of FIG. 9.
Figure 9A:
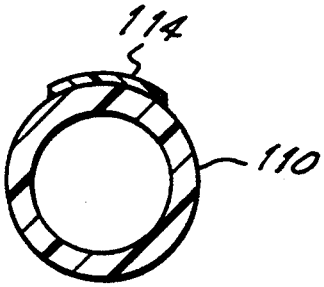

FIGS. 9 and 9A illustrate an alternative embodiment of the guide members of the present invention. In this regard, FIG. 9 shows a portion of an alternative apparatus 10' which is analogous to the upper end of frame section 18 shown in FIG. 1 and having a pair of guide members 108, 110 affixed thereto. Guide members 108, 110 may comprise, for example, polyvinylchloride tubing, as used for the frame members, which is rigid or substantially inflexible at room temperature but which has been heated and then bent to the desired shape. Alternatively, guide members 108, 110 may be formed of any other polymeric material which is rigid or substantially inflexible at room temperature but bendable to desired, continuously curved shapes upon heating thereof. Guide members 108, 110 include respective golf club shaft guide surfaces 112, 114 formed of a material suitable for reducing the friction between guide members 108, 110 and a golf club shaft during a practice swing. As best illustrated in FIG. 9A, guide surface 114 (and guide surface 112) preferably comprise Teflon® tape which is adhesively or otherwise affixed to the respective guide members 108, 110. Although the embodiment shown in FIGS. 9 and 9A is less advantageous than the preferred embodiment of the invention in that it involves higher manufacturing costs in bending the polyvinylchloride tubing to the appropriate curvature, it may be more desirable from the standpoint that an overall structure is formed which is somewhat more rigid and stable than the structure which uses polypropylene guide members or guide members formed of other material which is flexible at room temperature.

In operation, apparatus 10 is set up as shown in FIG. 1 and the student/golfer 88 is positioned as shown, i.e., centrally behind portion 20 of apparatus 10. Ideally, a golf instructor will set the proper initial back swing plane angle $\alpha$ of guide members 30, 32 and, by necessity, members 34, 36 although these are only used for guidance purposes when a left-handed golfer is using apparatus 10. The instructor then sets the appropriate steeper angle $\alpha'$ of guide members 38, 40 with respect to members 30, 32. As mentioned previously, these angles $\alpha$ and $\alpha'$ will vary from golfer to golfer and from club to club as well as on the desired choice thereof by the particular golf instructor. Once apparatus 10 is properly set: up and the golfer 88 is properly positioned with respect thereto, the golfer simply makes repeated back swings while maintaining light pressure of the golf club shaft 90 on guide members 30, 32 (guide members 34, 36 for left-handed golfers) and then onto guide members 38, 40 and continuing on to complete the back swing bringing the club to approximately a parallel position at the top of the swing. No follow through of the swing during this repeated practice exercise is necessary with the present invention. Rather, a properly executed back swing, grooved with the present invention, will naturally result in or at least greatly increase the likelihood of a properly executed down swing since the golf club will be starting downwardly in the correct swing plane and path.

Although preferred embodiments of the invention have been detailed above, those of ordinary skill in the art will readily recognize many substitutions and modifications thereof which fall within the scope and spirit of the invention. For example, the frame structure of the apparatus, although shown as being generally arcuate and following the curvature of the guide members, may be formed in many other shapes which facilitate its main function of supporting the guide members and the pressure exerted thereon by a golf club during a swing. Moreover, those of ordinary skill will also recognize that many different materials may be chosen for constructing various portions of the apparatus. In this regard, the only requirement in the preferred embodiment is that the frame structure be formed of a material which is substantially rigid or inflexible at room temperature while the guide members are formed of a material which is flexible enough at approximately room temperature to be bent into a continuous curve which generally follows the path of the golfer's back swing.

Those of ordinary skill will recognize further modifications to the invention and applicant therefore intends to be bound only by the scope of the claims appended hereto.

What is claimed is:

1. Golf swing training apparatus comprising:

a frame structure having a lower portion which includes a first golf club guide surface defining an initial back swing plane at a first angle relative to horizontal; and, an upper portion of said frame structure, said upper portion having a second golf club guide surface defining a second back swing plane at a steeper angle to the horizontal than said initial back swing plane of said first golf club guide surface.

2. The apparatus of claim 1 wherein the second back swing plane defined by said second golf club guide surface is angularly adjustable relative to the initial back swing plane defined by said first golf club guide surface.

3. The apparatus of claim 2 wherein said upper portion of said frame structure is attached to said lower portion of said frame structure so as to allow angular movement of said upper portion relative to said lower portion.

4. The apparatus of claim 1 wherein said lower portion of said frame structure comprises first and second generally arcuate sections hingedly connected to one another at a central portion of said frame structure.

5. The apparatus of claim 4 wherein first and second legs are respectively connected to said first and second generally arcuate sections such that said frame structure comprises a free standing structure.

6. The apparatus of claim 5 wherein said first and second legs are angularly adjustable relative to said arcuate sections.

7. The apparatus of claim 6 wherein said upper portion is connected to one of said first and second generally arcuate sections and a corresponding one of said first and second legs.

8. The apparatus of claim 7 wherein said upper portion is adjustably connected between said one generally arcuate section and said one leg to thereby allow said first and second golf club guide surfaces to be disposed at different relative angles to the horizontal.

9. The apparatus of claim 1 wherein the first golf club guide surfaces of said lower portion of said frame structure is generally arcuately shaped and includes first and second upper ends, wherein said upper portion of said frame structure is connected to one of said first and second upper ends.

10. The apparatus of claim 9 wherein said upper portion is releasably connected to said one upper end and is further releasably connectable to the other of said first and second upper ends for a golfer of opposite hand.

11. The apparatus of claim 1 wherein said frame structure is constructed out of a material which is substantially inflexible at room temperature and at least said first golf club guide surface is disposed on a guide member secured to said frame structure and being formed from a polymeric material which is flexible at room temperature and bent into an arcuate shape.

12. The apparatus of claim 11 wherein two guide members are connected to said frame structure, each being formed from a polymeric material which is flexible at room temperature and bent into an arcuate shape, wherein one of said guide members is an upper guide member for guiding an upper portion of a golf club shaft and the other of said guide members is a lower guide member for guiding a lower portion of said golf club shaft.

13. Golf swing training apparatus comprising:

a free standing frame structure formed from a plurality of interconnected, frame members which are rigid at room temperature;

a pair of guide rails formed from a material which is flexible at room temperature, each of said guide rails being bent into a curved shape and affixed to said frame structure such that outer surfaces thereof provide guide surfaces for a golf club shaft during a golf swing; and an upper portion connected to said frame structure and comprising interconnected frame members and attached guide rails, wherein said guide rails of said frame structure and said upper portion are adjustable with respect to one another such that the guide rails of said upper portion may be angled with respect to the guide rails of said frame structure at a predetermined, desired angle.

14. The apparatus of claim 13 wherein said frame members are formed from polyvinylchloride.

15. The apparatus of claim 13 wherein said guide rails are formed from polypropylene.

16. The apparatus of claim 13 wherein said frame members are formed from polyvinylchloride and said guide rails are formed from polypropylene.

17. The apparatus of claim 13 wherein said apparatus comprises two lower sections each being comprised of interconnected frame members and attached guide rails, said lower sections being hinged together at a central location of said apparatus.

18. The apparatus of claim 13 wherein first and second legs are respectively connected to said frame structure on a side thereof opposite to said guide rails, said legs extending downwardly at an angle relative to said frame structure.

19. The apparatus of claim 18 wherein said first and second legs are pivotally connected to said frame structure and thereby angularly adjustable relative thereto.

20. Golf swing training apparatus comprising:

a frame structure having a lower portion which includes a first golf club guide surface defining an initial back swing plane disposed at a first angle relative to horizontal; and, an upper portion of said frame structure, said upper portion having a second golf club guide surface, said second golf club guide surface defining a second back swing plane which is angularly adjustable relative to said first golf club guide surface and said initial back swing plane.

21. The apparatus of claim 20 wherein said second guide surface is adjustable to a steeper angle, relative to horizontal, than said first guide surface.

22. The apparatus of claim 20 wherein said frame structure includes adjustable legs which allow the initial back swing plane defined by said first golf club guide surface to be angularly adjusted relative to horizontal.

23. The apparatus of claim 22 wherein said adjustable legs allow angular adjustment of both said first and second golf club guide surfaces relative to horizontal.

24. Golf swing training apparatus comprising a frame structure having a golf club guide surface on a front side thereof and a pair of support legs extending rearwardly therefrom, said support legs pivotally connected to said frame structure at upper ends thereof, whereby said legs are pivotable between an opened, outwardly extended position for supporting said apparatus as a freestanding structure and a closed position adjacent said frame structure for storing said apparatus and, wherein said frame structure and guide surface comprise two sections releasably connected together centrally between said pair of support legs for allowing said two sections to be compactly stored.

25. The apparatus of claim 24 wherein said sections are hingedly connected to one another.

* * * * *